US007364453B2

(12) United States Patent
Matsuura et al.

(10) Patent No.: US 7,364,453 B2
(45) Date of Patent: Apr. 29, 2008

(54) LEVER-TYPE CONNECTOR WITH REINFORCING METALLIC PLATES

(75) Inventors: Yoshinori Matsuura, Makinohara (JP); Hiroaki Yamagishi, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/765,718

(22) Filed: Jun. 20, 2007

(65) Prior Publication Data

US 2007/0298637 A1 Dec. 27, 2007

(30) Foreign Application Priority Data

Jun. 26, 2006 (JP) ..... 2006-175503
Oct. 18, 2006 (JP) ..... 2006-283942

(51) Int. Cl.
*H01R 13/62* (2006.01)
*H01R 13/64* (2006.01)

(52) U.S. Cl. ..... 439/372; 439/157

(58) Field of Classification Search ..... 439/372, 439/157, 160, 310, 152
See application file for complete search history.

(56) References Cited

U.S. PATENT DOCUMENTS 6,190,187 B1 * 2/2001 Okabe et al. ..... 439/157
6,325,647 B1 * 12/2001 May et al. ..... 439/157
6,558,176 B1 * 5/2003 Martin et al. ..... 439/157
6,648,658 B2 * 11/2003 Okabe et al. ..... 439/157

FOREIGN PATENT DOCUMENTS

JP 2000-91027 A 3/2000
JP 2006-024457 A 1/2006

* cited by examiner

*Primary Examiner*—Hae Moon Hyeon
(74) *Attorney, Agent, or Firm*—Sughrue Mion, PLLC

(57) ABSTRACT

To provide a lever-type connector in which a sufficient strength and durability of a lever are secured so that a fitting operation can be effected positively, and also a thin design of the lever is achieved, a lever-type connector 10 includes a female housing, a lever 20 pivotally mounted on the female housing, and a male housing for fitting to the female housing, and the female and male housings are completely fitted to each other by pivotally moving the lever 20 engaged with the male housing. The lever 20 includes a resin-made lever base 26, and metallic plates 27, and the lever base includes a pair of side plate portions 29 disposed contiguous respectively to wall surfaces of the female housing, and an interconnecting portion 31 interconnecting one ends of the side plate portions 29, and the metallic plates are attached respectively to the side plate portions 29 in contiguous relation thereto, and an elastic lock arm 30 for retaining engagement with the female housing is formed at the interconnecting portion 31. The plates 27 are attached respectively to those surfaces of the side plate portions 29 opposed respectively to the wall surfaces of the female housing such that each of the plates is interposed between the corresponding side plate portion 29 and the female housing.

6 Claims, 8 Drawing Sheets

LEVER-TYPE CONNECTOR WITH REINFORCING METALLIC PLATES

BACKGROUND OF THE INVENTION

1. Field of the Invention

This invention relates to a lever-type connector comprising a female housing, a lever pivotally mounted on the female housing, and a male housing for fitting to the female housing, the female and male housings being completely fitted together by pivotally moving the lever engaged with the male housing.

2. Description of the Related Art

There is known a conventional technique in which in order to reduce an inserting force required for fitting female and male housings together, a lever mounted on one of the housings is engaged with the other housing, and then is pivotally moved to draw the other housing toward the one housing, thereby fitting the two housings together (see, for example, Patent Literature 1).

As shown in FIG. 8, in a lever-type connector 50 disclosed in Patent Literature 1, a lever 52 is pivotally mounted on a male housing 51, and a retaining projection 54 is formed on a lock arm 53 of the lever 52. The male housing 51 is inserted into a female housing 55, and then the lever 52 is pivotally moved, and by doing so, the retaining projection 54 is brought into retaining engagement with an engagement projection 56 of the female housing 55 while the lock arm 53 is elastically deformed, so that the male housing 51 is fitted to the female housing 55.

Also, in order to meet a recent demand for a compact design of connectors, there is known a lever-type connector in which a lever is formed by pressing a metal plate, thereby achieving a thin design of the lever (see, for example, Patent Literature 2).

Patent Literature 1: JP-A-2000-91027 Publication

Patent Literature 2: JP-A-2006-24457 Publication

However, in the lever-type connector 50 disclosed in the above Patent Literature 1, the whole of the lever 52 is made of a resin, and therefore when the lever is designed to have a sufficient strength, it becomes thick and has an increased size, and when the lever is formed into a thin design, there is a fear that its strength may become insufficient.

In the lever-type connector disclosed in the above Patent Literature 2, the lever is made of metal in order to achieve a thin design of the lever. Metal is superior in strength to a resin, but when a metal product is formed into a thin design, it can be plastically deformed by a relatively low load, and therefore can not withstand long use, and is disadvantageous from the viewpoint of durability.

SUMMARY OF THE INVENTION

This invention has been made in view of the above circumstances, and an object of the invention is to provide a lever-type connector in which a sufficient strength and durability of a lever are secured so that a fitting operation can be effected positively, and also a thin design of the lever is achieved.

The above object has been achieved by a lever-type connector of the present invention recited in the following Paragraphs (1) to (6).

(1) A lever-type connector comprising a female housing, a lever pivotally mounted on the female housing, and a male housing for fitting to the female housing, wherein the female and male housings are completely fitted to each other by pivotally moving the lever engaged with the male housing; characterized in that the lever includes a resin-made lever base, and metallic plates, and the lever base includes a pair of side plate portions disposed contiguous respectively to wall surfaces of the female housing, and an interconnecting portion interconnecting one ends of the side plate portions, and the metallic plates are attached respectively to the side plate portions in contiguous relation thereto, and an elastic lock arm for retaining engagement with the female housing is formed at the interconnecting portion; and the plates are attached respectively to those surfaces of the side plate portions opposed respectively to the wall surfaces of the female housing such that each of the plates is interposed between the corresponding side plate portion and the female housing.

(2) The lever-type connector of the above Paragraph (1) is characterized in that pivot holes are formed respectively in the plates, and are pivotally supported respectively by pivot shafts formed at the female housing.

(3) The lever-type connector of the above Paragraph (1) or Paragraph (2) is characterized in that each of the plates has a reinforcing portion which is formed by bending a relevant portion thereof, and the reinforcing portion generally surrounds a periphery of the corresponding side plate portion.

(4) The lever-type connector of the above Paragraph (3) is characterized in that a height of the reinforcing portion is smaller than a thickness of the side plate portion.

(5) The lever-type connector of any one of the above Paragraphs (1) to (4) is characterized in that bosses are formed respectively on the side plate portions, and boss holes are formed respectively in the plates, and the bosses are fitted respectively in the boss holes.

(6) The lever-type connector of any one of the above Paragraphs (1) to (5) is characterized in that the connector further comprises a wire cover for protecting wires which are connected respectively to terminals held in the female housing and extend outwardly from a rear side of the female housing; and the wire cover is attached to the female housing, and covers those surfaces of the side plate portions facing away respectively from the surfaces of the side plate portions opposed respectively to the wall surfaces of the female housing.

In the lever-type connector of the above Paragraph (1), the metallic plates are superposed respectively on the side plate portions of the resin-made lever base, and with this construction the overall strength of the lever can be increased, and besides the whole of the lever can be formed into a thin design by reducing the thickness of the side plate portions. Furthermore, each metallic plate is attached in a contiguous manner to the surface of the side plate portion opposed to the wall surface of the female housing, and is interposed between the side plate portion and the female housing, and with this arrangement the plates are prevented from being disengaged from the respective side plate portions, and can be positively connected with the side plate portions to provide a unitary structure. Furthermore, the lock arm for retaining engagement with the female housing is made of the resin, and with this construction the durability can be secured, utilizing the elasticity of the resin. Therefore, the sufficient strength and durability of the lever can be secured so that the fitting operation can be positively effected.

Furthermore, in the lever-type connector of the above Paragraph (2), the pivot holes supported by the pivot shafts of the female housing are formed in the plates, and therefore the strength of the pivot holes can be increased, and this can prevent breakage or the like which would otherwise occur if the pivot holes are formed in the resin-made side plate portions, and the side plate portions are made thin.

Furthermore, in the lever-type connector of the above Paragraph (3), the periphery of each resin-made side plate portion is covered with the reinforcing portion of the metallic plate, and therefore even when a load such as a bending stress acts on the side plate portions in the fitting operation of the lever, these side plate portions can sufficiently withstand this load.

Furthermore, in the lever-type connector of the above Paragraph (4), the metallic reinforcing portions do not project from the respective side plate portions, and will not be brought into direct contact with the housing (that is, the metal and the resin will not be brought into sliding contact with each other) when the lever is pivotally moved, and therefore wear, breakage, etc., can be prevented. Therefore, the operation for fitting the female and male housings together can be effected positively.

Furthermore, in the lever-type connector of the above Paragraph (5), the bosses formed on the side plate portions of the lever base are fitted respectively in the boss holes formed in the plates, and with this arrangement the plates are positioned relative to the respective side plate portions, and thereafter each plate will not be displaced relative to the corresponding side plate portion, and the plate and the side plate portion can jointly form a firm superposed-layer structure.

Furthermore, in the lever-type connector of the above Paragraph (6), the obverse and reverse surfaces of each side plate portion of the lever base are supported respectively by the wall of the female housing (opposed to the side plate portion) and the wire cover, and therefore a stress acting on the lever so as to tilt the side plate portions of the lever base in the direction of their thickness is borne not by the lever alone but by the three parts, that is, the lever, the housing and the wire cover. Therefore, the strength of the lever lowered by the thin design of the lever base and plates of the lever can be reinforced by the combination of the lever and the other parts. And besides, deformation of the lever base, developing during the molding thereof because of its thin design, can be corrected by the housing and the wire cover. Therefore, the lever base and the plates which jointly form the lever can be made thinner, and in the lever-type connector provided with the wire cover, a more lightweight design of the connector can be achieved.

In the present invention, there can be provided the lever-type connector in which the sufficient strength and durability of the lever are secured so that the fitting operation can be effected positively, and also the thin design of the lever is achieved.

DESCRIPTION OF THE PREFERRED EMBODIMENTS

A preferred embodiment of the present invention will now be described with reference to the drawings.

Figure 1:
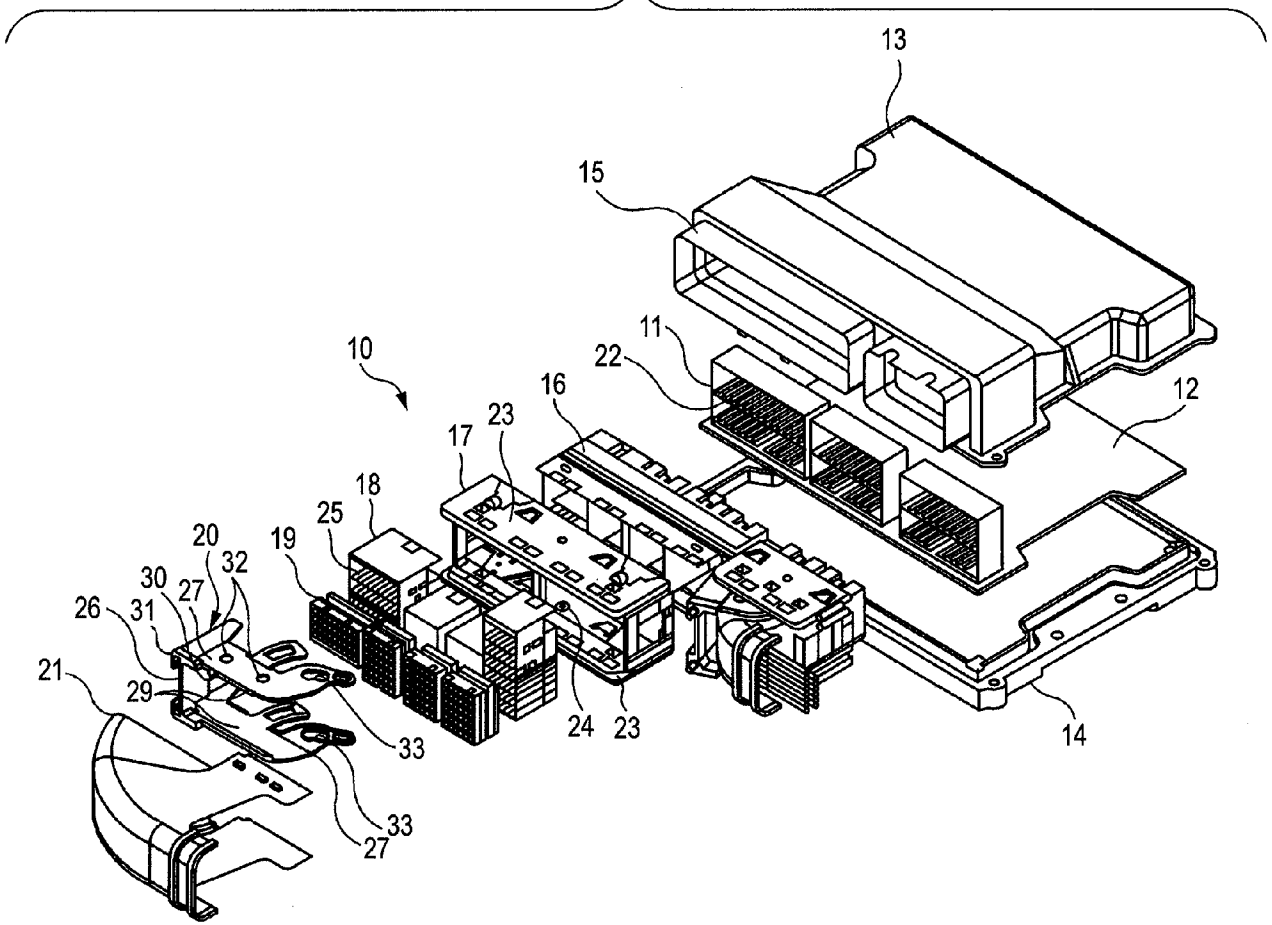
FIG. 1 is an exploded, perspective view showing various parts of one preferred embodiment of a lever-type connector of the present invention.
Figure 2:
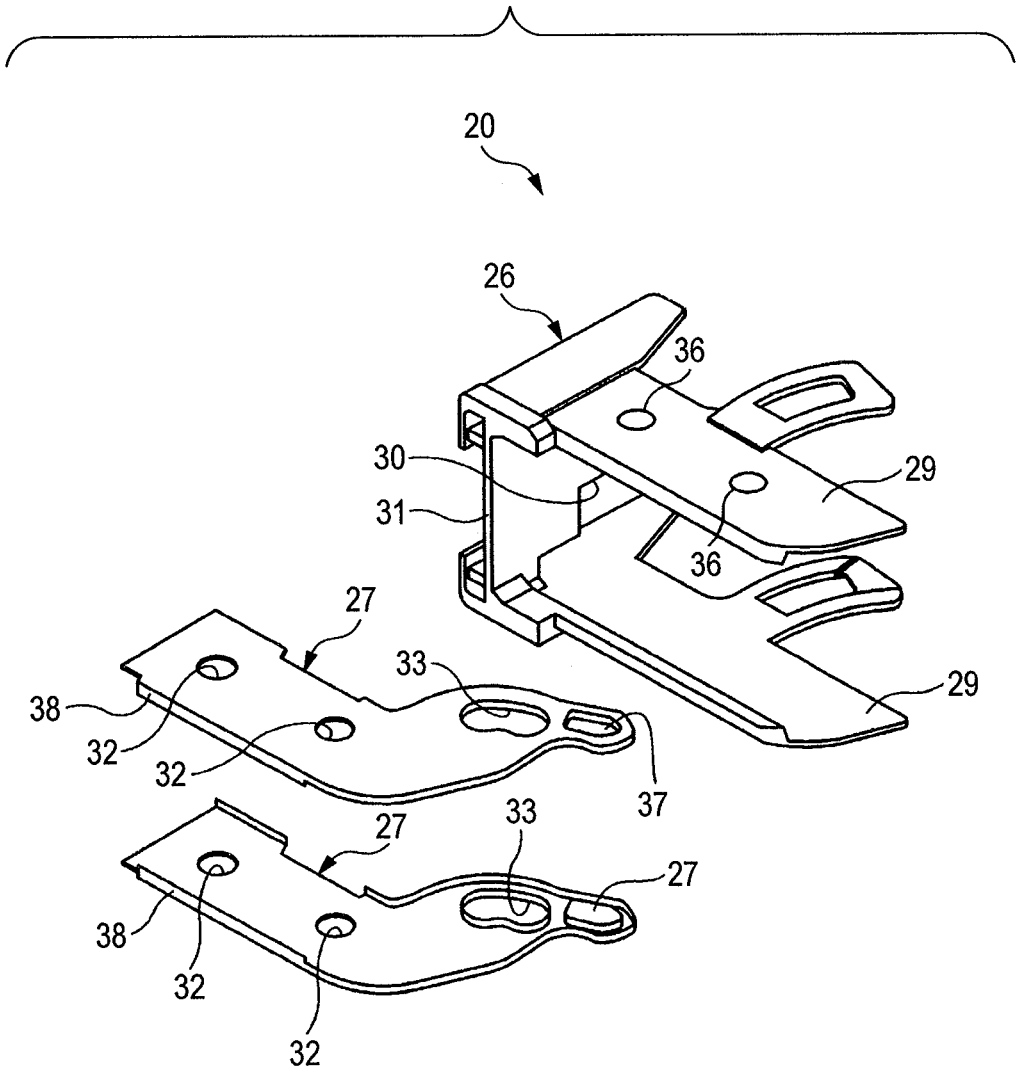
FIG. 2 is an exploded, perspective view of a lever used in the lever-type connector of FIG. 1.
Figure 3:
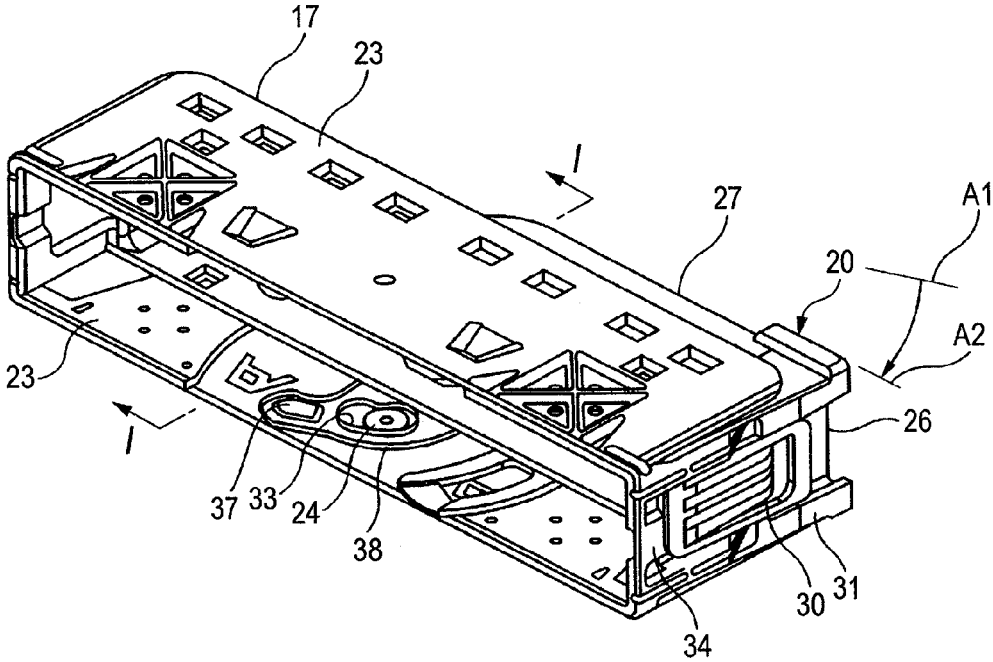
FIG. 3 is a perspective view showing the appearance of a female housing of the lever-type connector of FIG. 1 having the lever mounted thereon.
Figure 4:
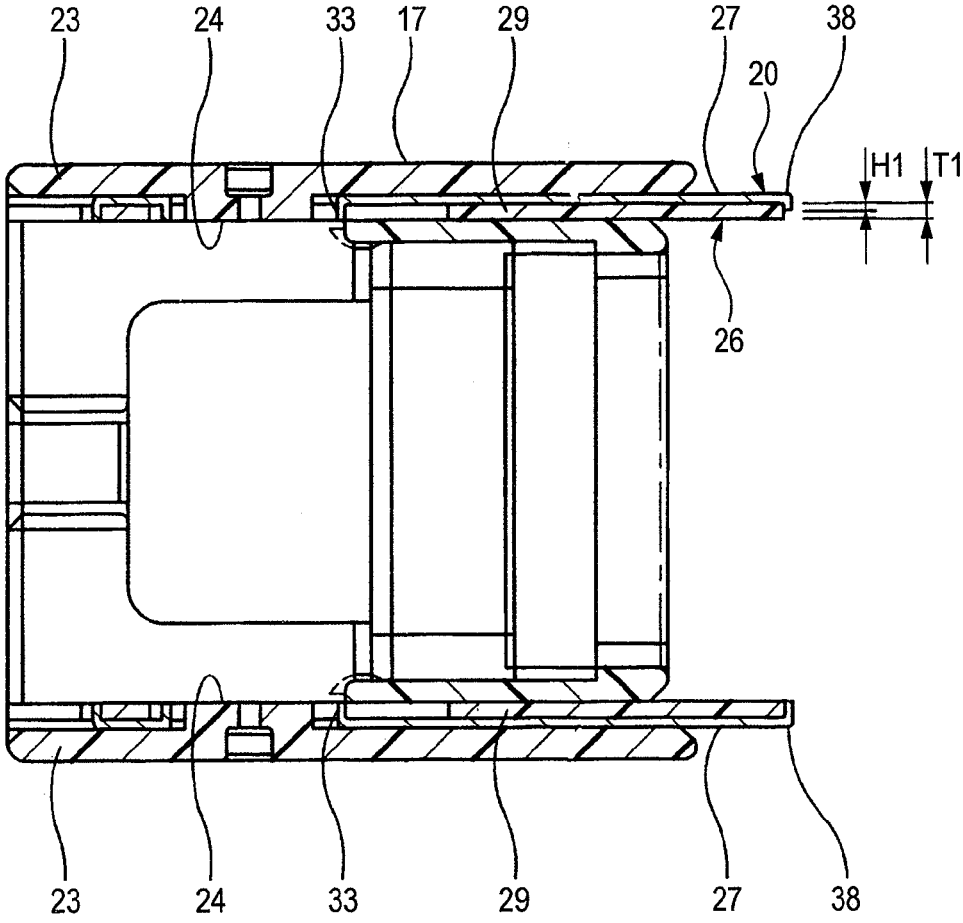
FIG. 4 is a cross-sectional view taken along the line I-I of FIG. 3.

FIG. 1 is an exploded, perspective view showing various parts of one preferred embodiment of a lever-type connector of the invention, FIG. 2 is an exploded, perspective view of a lever used in the lever-type connector of FIG. 1, FIG. 3 is a perspective view showing the appearance of a female housing of the lever-type connector of FIG. 1 having the lever mounted thereon, and FIG. 4 is a cross-sectional view taken along the line I-I of FIG. 3.

As shown in FIG. 1, the lever-type connector 10 comprises the female housing, the lever 20 pivotally mounted on this female housing, and a male housing for fitting to the female housing. The male housing includes male inner housings 11 holding a plurality of male terminals 22 mounted on a board 12, a male outer cover 13, and a board support base 14, the board 12 and the male inner housings 11 being interposed between the male outer cover 13 and the board support base 14. The female housing include a female inner housing 16, a female outer housing 17 for receiving this female inner housing 16, female plate housings 18, wire seals 19, and a wire cover 21.

The male inner housing 11 hold the plurality of male terminals 22 therein, and is fixed to a marginal portion of the board 12 on which these male terminals 22 are mounted. The male terminals 22 are electrically connected to printed wiring (not shown) (formed on the board 12) and electronic elements (not shown) mounted on the board 12. Although the male outer cover 13 and the board support base 14 cooperate with each other to receive the board 12 and the male inner housings 11 therebetween, the inner housings 11 and the male terminals 22 held in the inner housings are exposed through a hood portion 15 provided at the male outer cover 13.

The female inner housing 16 is formed into a square frame-like shape, and is received in the female outer housing 17 which has also a square frame-like shape and is slightly larger in size than the female inner housing 16. Pivot shafts 24 are formed on and project respectively from inner surfaces of a pair of opposed side walls 23 of the female outer housing 17, and the lever 20 is pivotally moved about the pivot shafts 24.

The female plate housing 18 holds a plurality of female terminals 25 therein, and is received in the female inner housing 16. Wires (not shown) electrically connected respectively to the female terminals 25 are held watertight by the wire seal 19 attached to the female plate housing 18, and are protected by the wire cover 21 attached to the outside of the female outer housing 17.

As shown in FIG. 2, the lever 20 includes a lever base 26 molded of a slightly elastic resin, and a pair of plates 27 formed of a metal plate.

The lever base 26 includes a pair of side plate portions 29 to be disposed contiguous respectively to the inner surfaces of the side walls 23 of the female outer housing 17, and an interconnecting portion 31 interconnecting one ends of these side plate portions 29. An elastic lock arm 30 for retaining engagement with the female outer housing 17 is formed at the interconnecting portion 31. Bosses 36 are formed on and project from that surface of each side plate portion 29 opposed to the inner surface of the corresponding side wall 23.

Each of the plates 27 has boss holes 32 in which the bosses 36 of the side plate portion 29 of the lever base 26 can be fitted, respectively. By fitting the bosses 36 into the respective boss holes 32, the plates 27 are positioned relative to the respective side plate portions 29, and are attached in a contiguous manner respectively to those surfaces of the side plate portions 29 opposed respectively to the inner surfaces of the side walls 23.

One end portions of the plates 27 project respectively beyond the free ends (remote from the ends interconnected by the interconnecting portion 31) of the side plate portion 29. A pivot hole 33 for the insertion of the pivot shaft 24 of the female outer housing 17 thereinto is formed through this one end portion of each plate 27, and further a drive projection 37 for engagement with the male housing is formed on and projects from that portion of the one end portion disposed closer to the distal end thereof than the pivot hole 33 is.

A reinforcing portion 38 is formed at an outer edge of each plate 27, and more specifically this reinforcing portion 38 is formed into a frame-like shape generally surrounding the periphery of the side plate portion 29 of the lever base 26 by bending an outer edge portion of the plate 27. As shown in FIG. 4, a height H of the reinforcing portion 38 is smaller than a thickness T of the side plate portion 29, and an edge of the reinforcing portion 38 will not project beyond the inner surface of the side plate portion 29 (facing away from the outer surface thereof opposed to the inner surface of the side wall 23).

As shown in FIG. 3, the lever 20 is pivotally supported on the female outer housing 17, with the pivot shafts 24 of the female outer housing 17 inserted respectively in the pivot holes 33 of the plates 27. Here, each plate 27 is interposed between the corresponding side plate portion 29 of the lever base 26 (disposed in contiguous relation to the inner surface of the side wall 23 of the female outer housing 17) and this side wall 23.

When the lever 20 is held in an unlocked position A1 shown in FIG. 3, the male housing and the female housing are fitted to each other. Here, the female inner housing 16 enters the hood portion 15 of the male outer cover 13, while the hood portion 15 enters the female outer housing 17. Cams (not shown) for engagement with the respective drive projections 37 formed respectively on the plates 27 of the lever 20 are formed at the hood portion 15.

The cams of the hood portion 15 are engaged respectively with the drive projections 37 of the lever 20, and in this condition when the lever 20 is pivotally moved, the lever 20 functions to draw the hood portion 15 into the female outer housing 17, and the female inner housing 16 is inserted deeper into the hood portion 15, and is fitted to the male inner housing 11. When the lever 20 reaches a locked position A2 shown in FIG. 3, the female inner housing 16 is completely fitted to the male inner housing 11, and the female terminals 25 are connected to the respective male terminals 22.

When the lever 20 thus reaches the locked position A2, the lock arm 30 is retained by a lock arm receiving portion 34 formed at the female outer housing 17, so that the lever 20 is prevented from further pivotal movement.

As described above, in the lever-type connector 10 of this embodiment, the metallic plates 27 are superposed respectively on the side plate portions 29 of the resin-made lever base 26, and with this construction the overall strength of the lever 20 can be increased, and besides the whole of the lever can be formed into a thin design by reducing the thickness of the side plate portions 29. Furthermore, each metallic plate 27 is attached in a contiguous manner to the outer surface of the side plate portion 29 opposed to the inner surface of the side wall 23 of the female outer housing 17, and is interposed between the side plate portion 29 and the female outer housing 17, and with this arrangement the plates 27 are prevented from being disengaged from the respective side plate portions 29, and can be positively connected with the side plate portions 29 to provide a unitary structure. Furthermore, the lock arm 30 for retaining engagement with the female outer housing 17 is made of the resin, and with this construction the durability can be secured, utilizing the elasticity of the resin. Therefore, the sufficient strength and durability of the lever 20 are secured so that the fitting operation can be effected positively.

Furthermore, in the lever-type connector 10 of this embodiment, the pivot holes 33 supported by the pivot shafts 24 of the female outer housing 17 are formed in the metallic plates 27, and therefore the strength of the pivot holes 33 can be increased, and this can prevent breakage or the like which would otherwise occur if the pivot holes 33 are formed in the side plate portions 29 of the resin-made lever base 26, and the side plate portions 29 are made thin.

Furthermore, in the lever-type connector 10 of this embodiment, the periphery of each side plate portion 29 of the resin-made lever base 26 is covered with the reinforcing portion 38 of the metallic plate 27, and therefore even when a load such as a bending stress acts on the side plate portions 29 in the fitting operation of the lever 20, these side plate portions can sufficiently withstand this load.

Furthermore, in the lever-type connector 10 of this embodiment, the metallic reinforcing portions 38 do not project from the respective side plate portions 29, and will not be brought into direct contact with the housing (that is, the metal and the resin will not be brought into sliding contact with each other) when the lever 20 is pivotally moved, and therefore wear, breakage, etc., can be prevented. Therefore, the operation for fitting the female and male housings together can be effected positively.

Furthermore, in the lever-type connector 10 of this embodiment, the bosses 36 formed on the side plate portions 29 of the lever base 26 are fitted respectively in the boss holes 32 formed in the plates 27, and with this arrangement the plates 27 are positioned relative to the respective side plate portions 29, and thereafter each plate 27 will not be displaced relative to the corresponding side plate portion 29, and the plate 27 and the side plate portion 29 can jointly form a firm superposed-layer structure.

Next, a modified example of the above-mentioned lever-type connector 10 will be described with reference to FIGS. 5 to 7.

Figure 5:
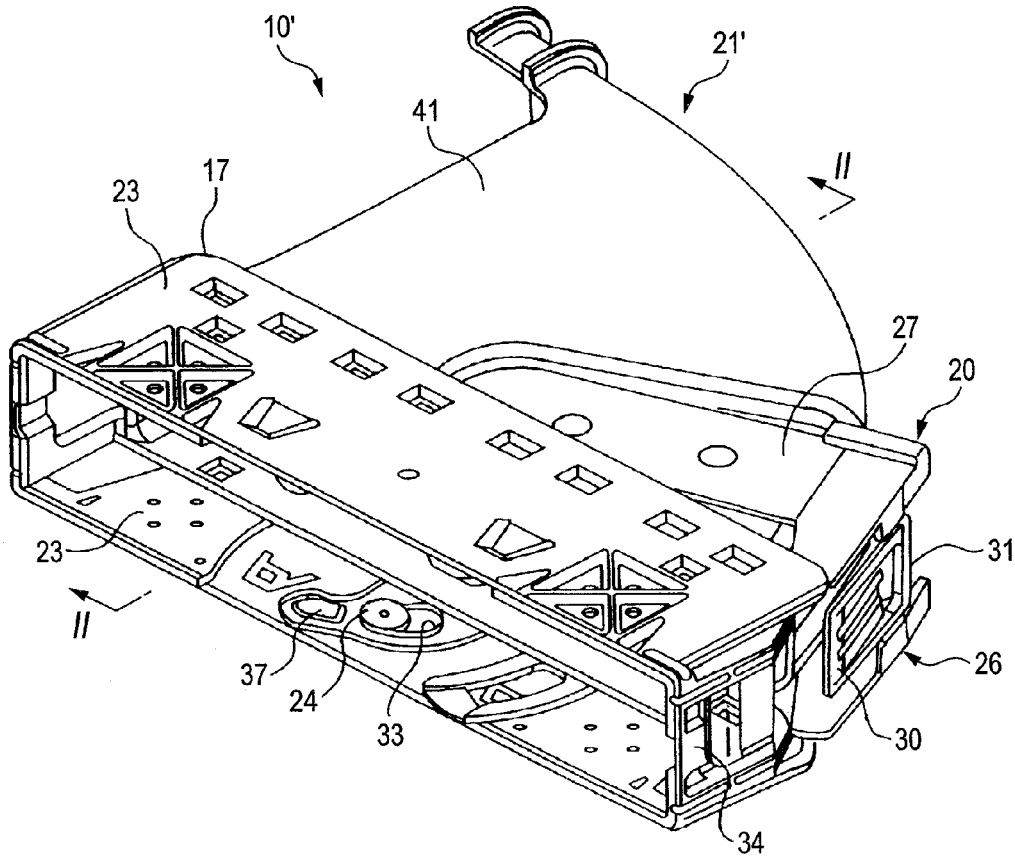
FIG. 5 is a perspective view showing the appearance of a female housing of a modified example of the lever-type connector of FIG. 1 having a lever mounted thereon.
Figure 6:
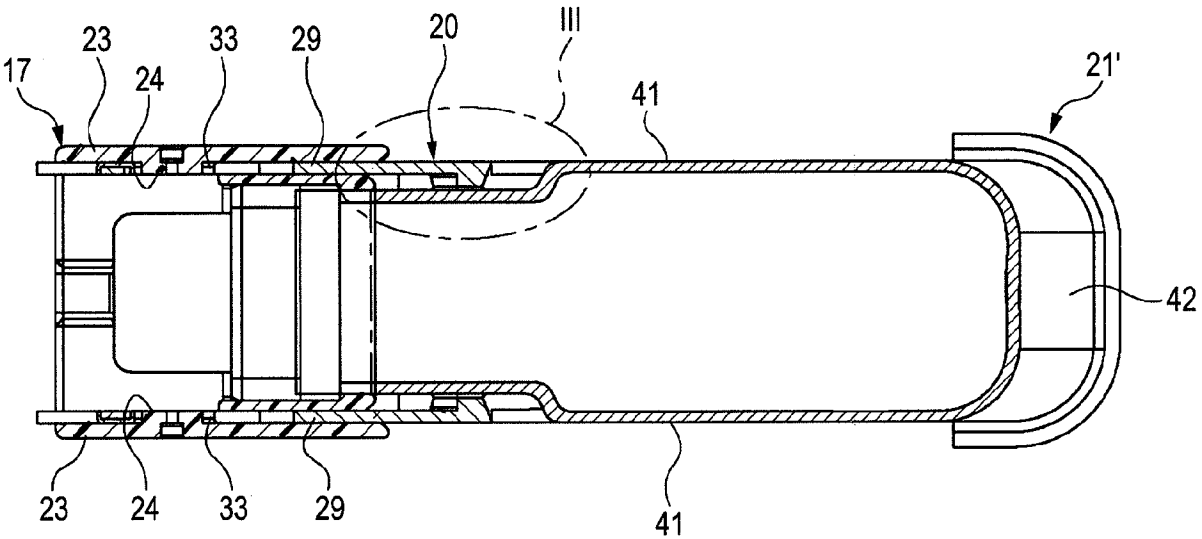
FIG. 6 is a cross-sectional view taken along the line II-II of FIG. 5.
Figure 7:
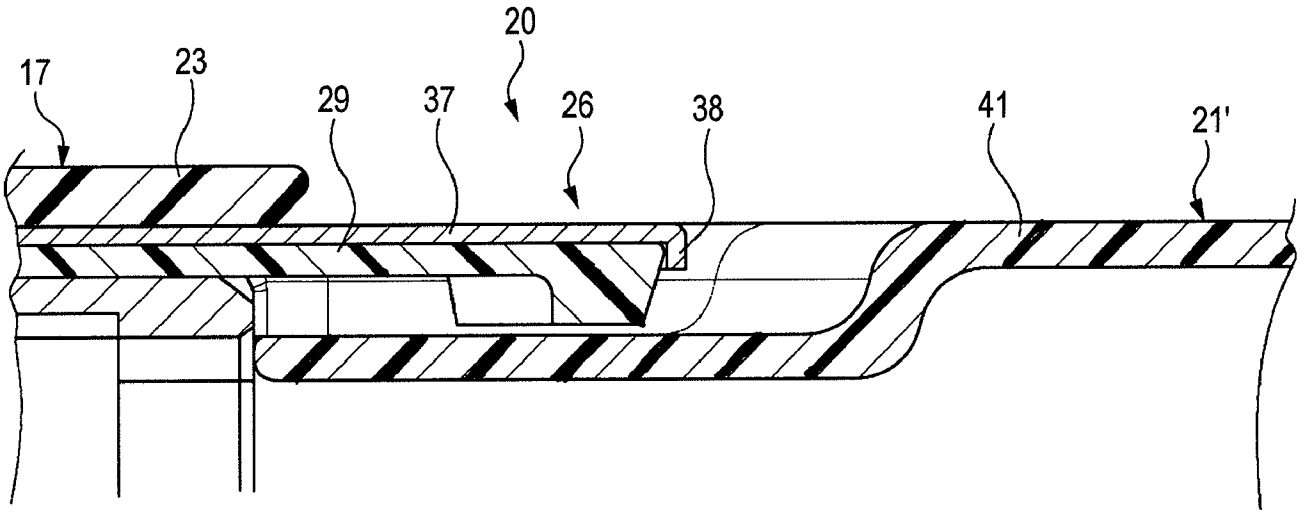
FIG. 7 is an enlarged view of a portion encircled by a dot-and-dash line III of FIG. 6.
Figure 8:
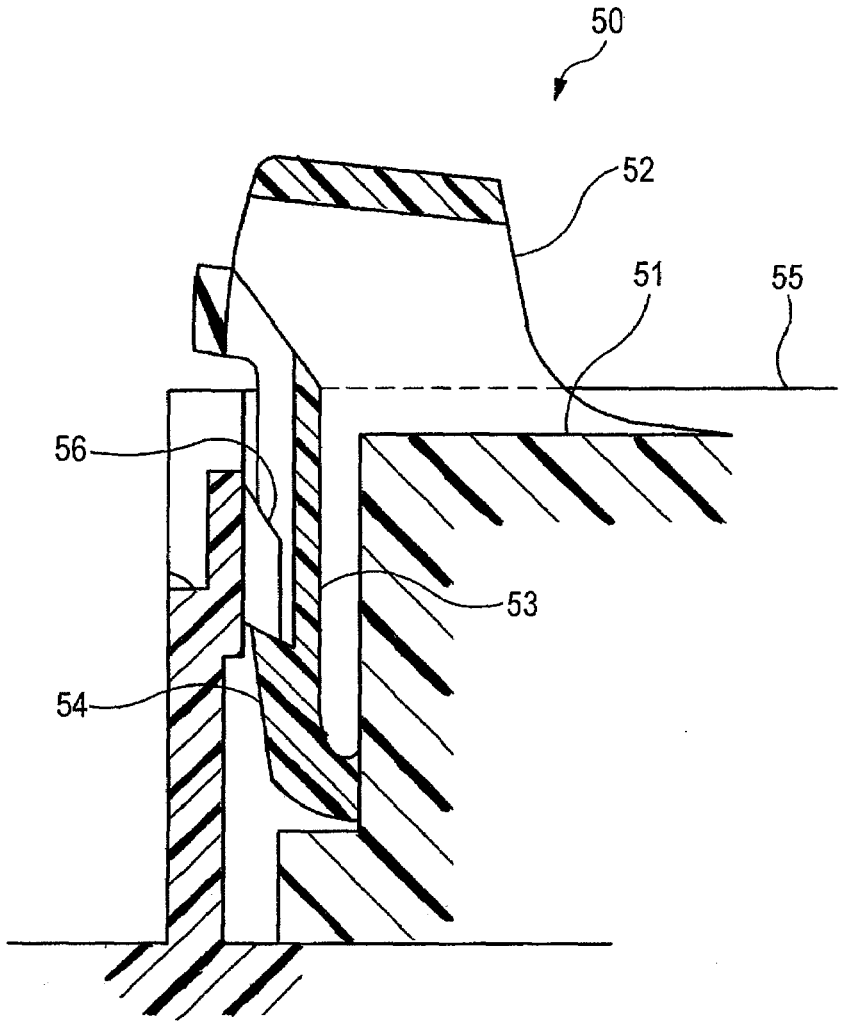
FIG. 8 PRIOR ART
FIG. 8 is a cross-sectional view of a conventional lever-type connector.

FIG. 5 is a perspective view showing the appearance of a female housing of the modified example of the lever-type connector of FIG. 1 having a lever mounted thereon, FIG. 6 is a cross-sectional view taken along the line II-II of FIG. 5, and FIG. 7 is an enlarged view of a portion encircled by a dot-and-dash line III of FIG. 6. Those constituent elements identical to those of the above-mentioned lever-type connector 10 will be designated by identical reference numerals, respectively, and explanation thereof will be omitted or will be made briefly.

As shown in FIG. 5, in the lever-type connector 10' of this modified example, wires (not shown) are connected respectively to a plurality of female terminals 25 received in a female inner housing 16, and these wires are led out or extended outwardly from a rear side of the female housing, that is, in a direction opposite to a direction of fitting of the female housing to a male housing.

The lever-type connector 10' includes a wire cover 21' for protecting the group of wires extending outwardly from the rear side of the female housing, and this wire cover 21' includes a pair of generally fan-shaped side plate portions 41, and an interconnecting portion 42 interconnecting arc-shaped edges of the side plate portions 41.

The interconnecting portion 42 of the wire cover 21' is disposed at that side where an interconnecting portion 31 of a lever base 26 is disposed, and the pair of side plate portions 41 are inserted between a pair of side plate portions 29 of the lever base 26, and an inner surface of each side plate portion 29 of the lever base 26, facing away from an outer surface thereof opposed to an inner surface of a corresponding side wall 23 of a female outer housing 17, is covered with the corresponding side plate portion 41, and the side plate portion 29 of the lever base 26 is supported from the inner side thereof in a direction of a thickness thereof. The wire cover 21' is attached to the female outer housing 17 in this manner.

The group of wires extending outwardly from the rear side of the female housing are curved along the interconnecting portion 42 of the wire cover 21', and are arranged to extend in a direction away from the interconnecting portion 31 of the lever base 26, so that the group of wires will not interfere with the pivotally-moving lever 20.

In the lever-type connector 10' of this modified example, the obverse and reverse surfaces of each side plate portion 29 of the lever base 26 are supported respectively by the side wall 23 of the female outer housing 17 and the side plate portion 41 of the wire cover 21', and therefore a stress acting on the lever 20 so as to tilt the side plate portions 29 of the lever base 26 in the direction of their thickness is borne not by the lever 20 alone but by the three parts, that is, the lever 20, the female outer housing 17 and the wire cover 21'. Therefore, the strength of the lever 20 lowered by the thin design of the lever base 26 and plates 27 of the lever 20 can be reinforced by the combination of the lever and the other parts. And besides, deformation of the lever base 26, developing during the molding thereof because of its thin design, can be corrected by the female outer housing 17 and the wire cover 21'. Therefore, the lever base 26 and the plates 27 which jointly form the lever 20 can be made thinner, and in the lever-type connector provided with the wire cover, a more lightweight design of the connector can be achieved. Other advantageous effects are similar to those of the above-mentioned lever-type connector 10, and therefore explanation thereof is omitted.

The present invention is not limited to the above embodiment, and suitable modifications, improvements, etc., can be made. Furthermore, the material, shape, dimensions, numerical values, form, number, disposition, etc., of each of the constituent elements of the above embodiment are arbitrary and are not limited in so far as the invention can be achieved.

What is claimed is:

1. A lever-type connector, comprising:

a female housing;

a lever pivotally mounted on said female housing; and a male housing for fitting to said female housing, wherein said female and male housings are completely fitted to each other by pivotally moving said lever engaged with said male housing;

said lever includes a resin-made lever base, and metallic plates; and said lever base includes a pair of side plate portions disposed contiguous respectively to wall surfaces of said female housing, and an interconnecting portion interconnecting one ends of said side plate portions; and said metallic plates are attached respectively to said side plate portions in contiguous relation thereto, and an elastic lock arm for retaining engagement with said female housing is formed at said interconnecting portion; and said plates are attached respectively to those surfaces of said side plate portions opposed respectively to said wall surfaces of said female housing such that each of said plates is interposed between the corresponding side plate portion and said female housing.

2. The lever-type connector according to claim 1, wherein pivot holes are formed respectively in said plates, and are pivotally supported respectively by pivot shafts formed at said female housing.

3. The lever-type connector according to claim 1, wherein each of said plates has a reinforcing portion which is formed by bending a relevant portion thereof, and said reinforcing portion generally surrounds a periphery of the corresponding side plate portion.

4. The lever-type connector according to claim 3, wherein a height of said reinforcing portion is smaller than a thickness of said side plate portion.

5. The lever-type connector according to any one of claims 1 to 4, wherein bosses are formed respectively on said side plate portions, and boss holes are formed respectively in said plates, and said bosses are fitted respectively in said boss holes.

6. The lever-type connector according to claim 1, wherein said connector further comprises a wire cover for protecting wires which are connected respectively to terminals held in said female housing and extend outwardly from a rear side of said female housing; and said wire cover is attached to said female housing, and covers those surfaces of said side plate portions facing away respectively from the surfaces of said side plate portions opposed respectively to said wall surfaces of said female housing.

* * * * *